US011879244B2

(12) United States Patent
Ethier

(10) Patent No.: US 11,879,244 B2
(45) Date of Patent: Jan. 23, 2024

(54) ADD-ON BIDET MODULE FOR A TOILET

(71) Applicant: Denis Ethier, St-Gerard (CA)

(72) Inventor: Denis Ethier, St-Gerard (CA)

( * ) Notice: Subject to any disclaimer, the term of this patent is extended or adjusted under 35 U.S.C. 154(b) by 0 days.

(21) Appl. No.: 17/693,390

(22) Filed: Mar. 13, 2022

(65) Prior Publication Data

US 2023/0287670 A1 Sep. 14, 2023

(30) Foreign Application Priority Data

Mar. 13, 2021 (GB) ..... 2103509

(51) Int. Cl.
*E03D 9/08* (2006.01)

(52) U.S. Cl.
CPC ..... *E03D 9/085* (2013.01)

(58) Field of Classification Search
CPC ..... E03D 9/08; A47K 13/005; Y10S 4/05
USPC ..... 4/420.4, DIG. 5, 234, 237
See application file for complete search history.

(56) References Cited

U.S. PATENT DOCUMENTS 1,056,361 A * 3/1913 Podmore ..... E03D 11/025 4/341
1,799,815 A * 4/1931 Hoff ..... E03C 1/066 4/615
3,430,267 A 4/1969 Van Houten
3,430,268 A 4/1969 Zoberg
3,662,407 A * 5/1972 Colucci ..... E03D 9/085 392/475
4,181,985 A 8/1980 Rius
4,406,025 A 9/1983 Huck et al.
4,596,058 A 6/1986 Nourbakhsh
5,023,961 A 6/1991 Alonso
4,998,300 A 12/1991 Sharifzadeh
5,090,067 A * 2/1992 Cogdill ..... E03D 9/085 4/420.4
5,991,937 A 11/1999 Safara
6,321,396 B1 11/2001 Vallejo
6,671,892 B1 6/2004 Plyant
6,978,492 B1 12/2005 Francisco et al.
(Continued)

FOREIGN PATENT DOCUMENTS

CN 202064426 U * 12/2011
KR 101589697 B1 * 1/2016
KR 20170021550 A * 2/2017

OTHER PUBLICATIONS

CN-202064426-U Translation (Year: 2023).*
KR-20170021550-A Translation (Year: 2023).*
KR-101589697-B1 Translation (Year: 2023).*

*Primary Examiner* — David P Angwin
*Assistant Examiner* — William R Klotz

(57) ABSTRACT

An add-on bidet module for a toilet includes an extendable hose and toilet seat that can be used in modifying an existing toilet or for a toilet having those accessories pre-installed for use as a bidet on a toilet. The accessories also include a compartment with door for storing toilet related products attached to the side of the toilet tank, and a toilet seat having at least one flap opening to allow for the passage of the nozzle. The aforementioned accessories which can include compartments with doors to hide the hose and nozzle as well as for storing toilet related products can form part of a manufactured toilet having those accessories included. A water heater is provided to delivery temperature controlled water to the user.

11 Claims, 13 Drawing Sheets

(56) References Cited

U.S. PATENT DOCUMENTS

| | | | | |
|---|---|---|---|---|
| 7,127,750 | B2 | 10/2006 | Tak et al. | |
| 8,281,423 | B2 * | 10/2012 | Taylor | A61M 3/0279 4/420.4 |
| 9,587,391 | B1 | 7/2017 | Anderson | |
| 2006/0150311 | A1 * | 7/2006 | Chang Chien | E03D 9/085 4/420.4 |
| 2008/0134423 | A1 | 6/2008 | Ding | |
| 2012/0011647 | A1 | 1/2012 | Mochita et al. | |
| 2013/0191980 | A1 * | 8/2013 | Khiroya | A47K 13/005 4/237 |
| 2014/0096335 | A1 * | 4/2014 | Okada | A47K 7/08 15/231 |
| 2014/0310865 | A1 * | 10/2014 | Lin | A47K 13/24 4/300.3 |
| 2019/0368182 | A1 * | 12/2019 | Ethier | E03D 9/00 |

* cited by examiner

FIG. 8A
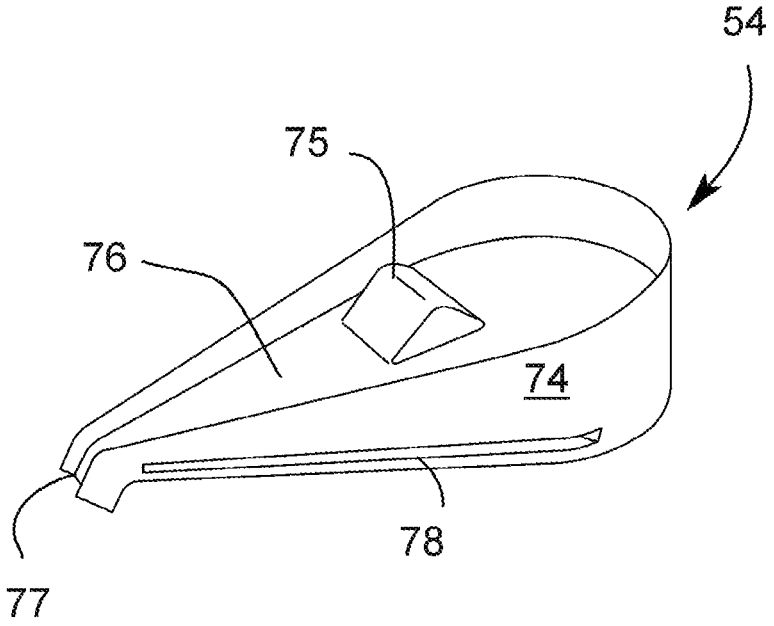
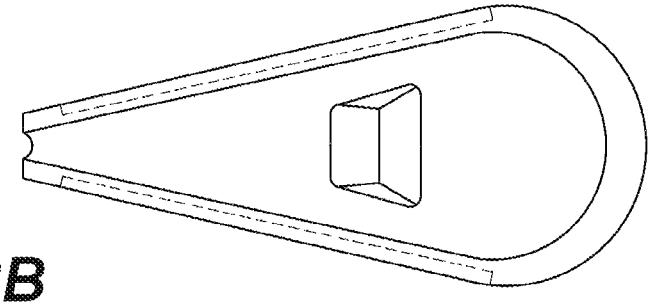
FIG. 8B

FIG. 9A
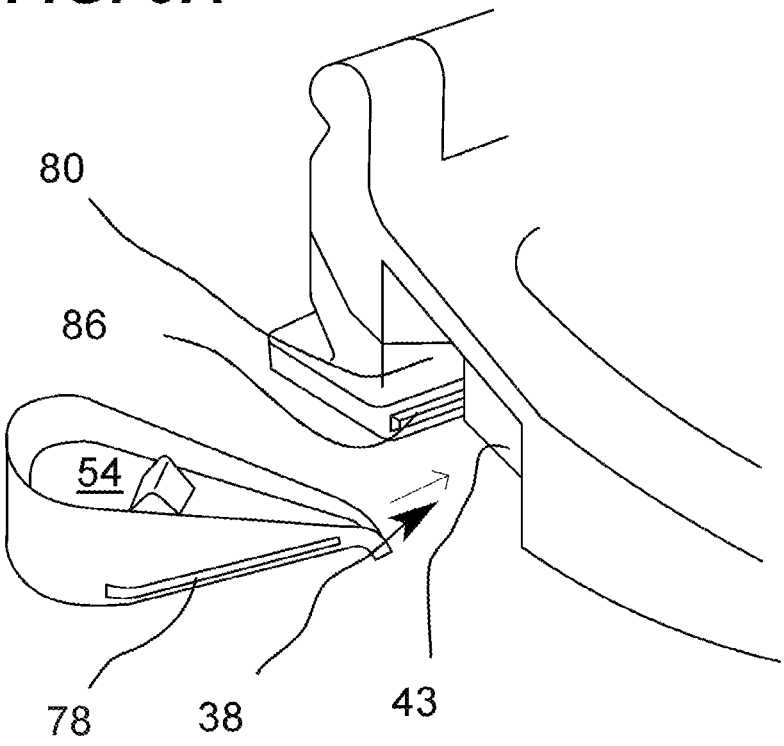
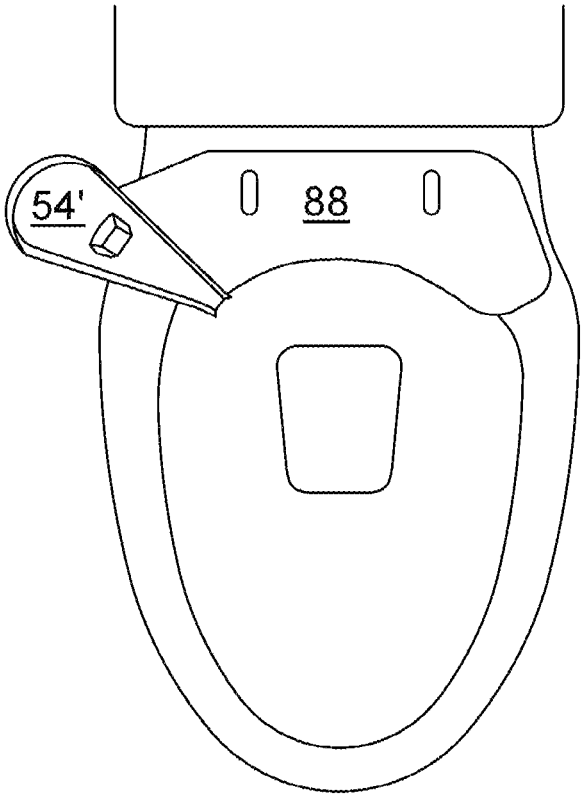
FIG. 9B

ADD-ON BIDET MODULE FOR A TOILET

CROSS-REFERENCE TO RELATED APPLICATIONS

The present application claims priority to application number GB2103509.2, filed on Mar. 13, 2021, the disclosure of which is hereby incorporated in its entirety at least by reference.

BACKGROUND OF THE INVENTION

1. Field of the Invention

The present invention relates generally to toilet accessories and more particularly to an add-on bidet module for a toilet.

2. Description of Related Art

With the advent of modern toilets, different means have been developed for sanitary washing of the intimate parts after defecation and urination. Examples of such means include toilet paper, wet and gel wipes, cloths, and bidets.

While different people have different preferences with regard to sanitary washing, bidets have proved popular as they generally allow cleaning of intimate parts more thoroughly than with toilet paper and cloths.

Bidets are generally used to wash and clean the genitalia, perineum, inner buttocks and anus using a water jet, thus replacing or complementing the use of toilet paper.

Different bidet systems have been developed, including ceramic floor-mounted bidets, ceramic wall-mounted bidets, non-electric seat bidets and electric seat bidets. Generally, bidet showers, also known as bidet sprays, bidet sprayer and health faucet, are used for anal cleansing and cleansing of the genitals after defecation and urination. Bidet showers generally consist in a hand-held triggered nozzle connected to an end of a hose for delivering a spray of water to assist cleansing. However, ceramic bidets may require a lot of bathroom space, and may be costly, while electric bidets may also be costly and difficult to install.

While less costly, toilets with bidet showers may not always be aesthetically pleasing, as the hose may be visible and cumbersome, and may not always be practical to use, as the hose may be dangling, and necessitating the user to be in an uncomfortable position during sanitary washing. There is therefore a need for a toilet or a way to modify existing toilets so that they can have a bidet shower that is convenient to use, hygienic, and allows hiding the bidet shower at least partially when not in use.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a main object of the present disclosure to alleviate at least some of the inconveniences present in the prior art.

In order to do so, an add-on bidet module for a toilet is provided, the add-on bidet module comprising a standing pedestal configured to be positioned on a floor surface; a water inlet hose configured to be coupled to a water source to direct water to the add-on bidet module; an outlet hose coupled to an extendable nozzle configured to spray the water during use; and, a faucet for controlling the flow of the water.

In one embodiment, a water heater is provided configured to heat the water directed from the water source. In one embodiment, the nozzle includes a trigger for controlling the flow of the water. In another embodiment, the nozzle includes a jet selector switch to adjust the spray of the water during use. In one embodiment, the outlet hose is covered by a sheath. In another embodiment, a height adjustment knob is provided configured to adjust the height of the sheath and the attached nozzle. In one embodiment, a toilet seat is provided having a flap opening configured to enable the nozzle to pass through to a bowl of the toilet. In yet another embodiment, a platform is provided, wherein the nozzle is configured to rest on the platform. In one embodiment, the platform is shaped to collect and direct water to the bowl. In another embodiment, the platform comprises grooves configured to engage a drive track positioned on the toilet seat such that the platform is removably attached to the toilet seat. In yet another embodiment, a protective partition is provided configured to adjustably slide along a pair of tracks provided on the toilet seat such that protective partition prevents the water from spraying outside the toilet bowl. In one embodiment, the protective partition is configured to be stored in a holder positioned on a toilet seat cover hingedly attached to the toilet seat. In another embodiment, a storage compartment configured to attach to a toilet tank of the toilet is provided.

In another aspect of the invention, an add-on bidet module for a toilet is provided, the add-on bidet module comprising a standing pedestal configured to be positioned on a floor surface; a water inlet hose configured to be coupled to a water source to direct water to the add-on bidet module; an outlet hose coupled to an extendable nozzle configured to spray the water during use; a platform, wherein the nozzle is configured to rest on the platform; a faucet for controlling the flow and temperature of the water; a toilet seat having or providing a passage for the nozzle to enter a toilet bowl of the toilet; a compartment attached to a side portion of a toilet tank, wherein the compartment is configured to store or hide at least a portion of the nozzle; and, a door configured to access the compartment.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which:

FIGS. 8A-B illustrate isometric, and top views respectively, of the platform.

FIGS. 9A-B illustrate an isometric view of the platform and its storage bracket and top view of the alternate platform for use on the standard toilet of FIG. 6.

DETAILED DESCRIPTION OF THE PREFERRED EMBODIMENT

Figure 1:
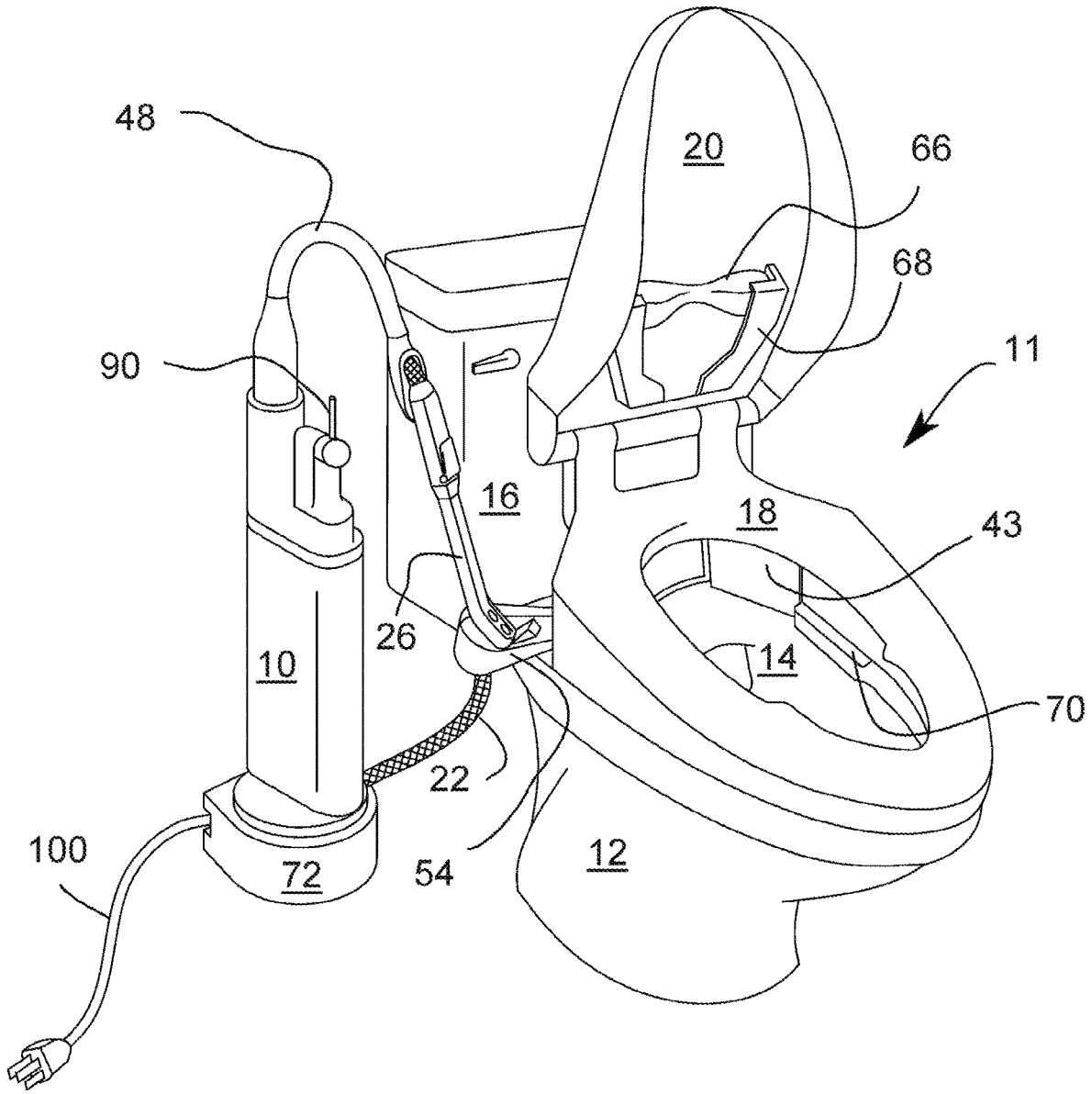
FIG. 1 an isometric view of an add-on bidet module for a toilet according to an embodiment of the present invention.
Figure 2:
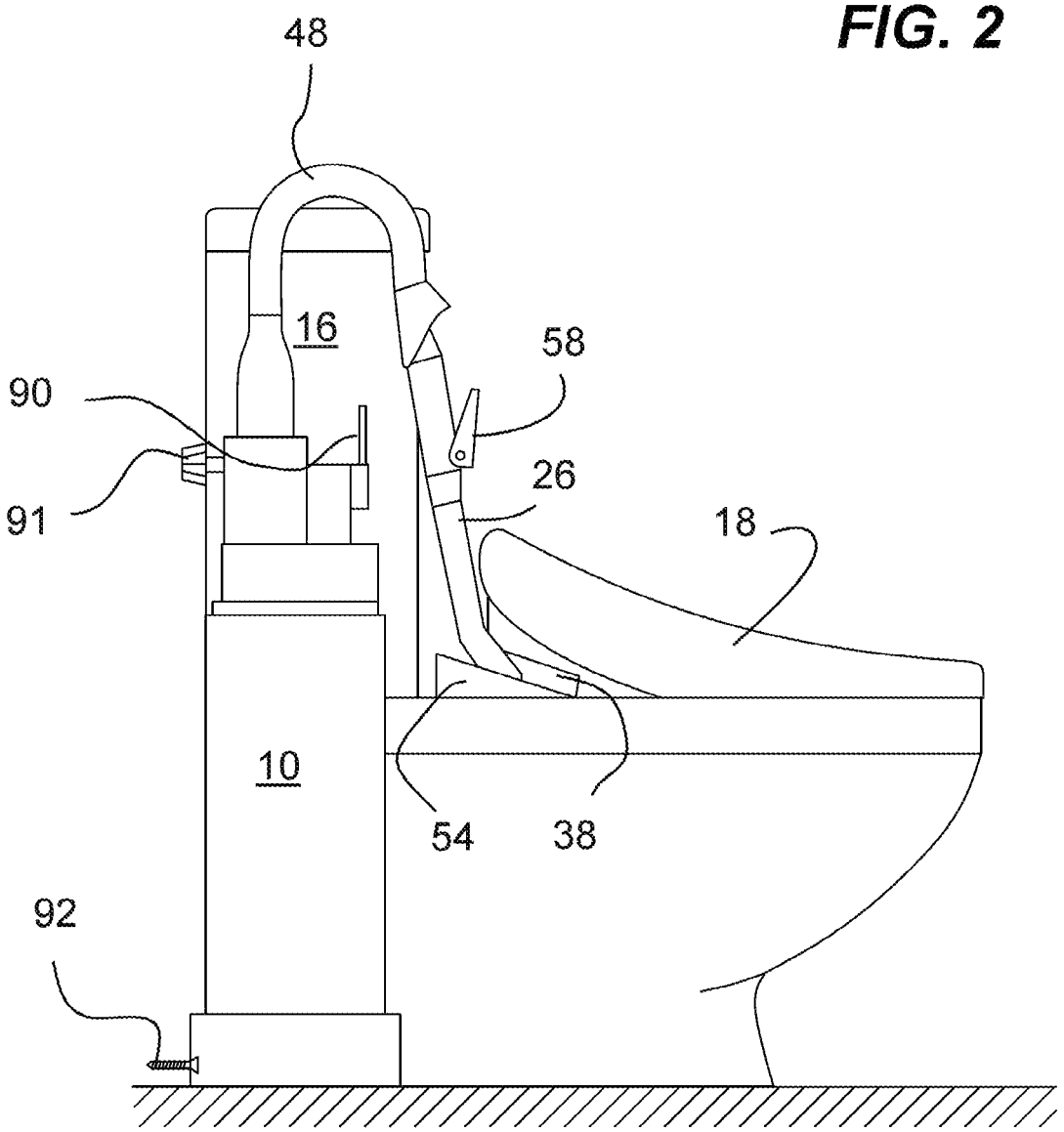
FIG. 2 is a side view of the add-on bidet module for a toilet according to an embodiment of the present invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide an add-on bidet module for a toilet.

It is to be understood that the terminology used herein is for the purpose of describing particular embodiments only and is not intended to be limiting. The terms "a" or "an," as used herein, are defined as to mean "at least one". The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanent. The term "providing" is defined herein in its broadest sense, e.g., bringing/coming into physical existence, making available, and/or supplying to someone or something, in whole or in multiple parts at once or over a period of time. As used herein, the terms "about", "generally", or "approximately" apply to all numeric values, whether or not explicitly indicated. These terms generally refer to a range of numbers that one of skill in the art would consider near the stated amount by about 0%, 5%, or 10%, including increments therein. In many instances these terms may include numbers that are rounded to the nearest significant figure.

Referring now to any of the accompanying FIGS. 1-13, an add-on module 10 for a toilet 11 is illustrated. In one embodiment, the add-on module 10 is in the form of a pedestal located on the floor next to the toilet 11. Although, the design of the toilet may vary, the illustrated toilet 11 is similar to a standard toilet having a base 12, a bowl 14, and a tank 16. In some embodiments, toilet seat 18 and a toilet seat cover 20 form part of the add-on module 10 as these elements are replaced on when the add-on module is installed. More specifically, the seat is different than a standard toilet seat by way of a flap opening 38 on each side of the seat 18 which allows for the passage of a nozzle 26 which is long enough to clean the buttocks as well as genitalia.

In some embodiments, a protective partition 66 is provided that is configured and sized to adjustably slide along a pair of tracks 70, wherein the pair of tracks 70 and configured to fit inside the bowl 14 preventing the nozzle 26 from spraying outside of the bowl 14, as well as limiting the amount of water being sprayed on the user and also protect the genitalia. When not in use, the partition 66 stays in a holder 68.

Other components of the present invention include a water inlet hose 22 configured to bring water to the add-on module 10, and a sheath 48 through which passes an end hose 24 connecting to the nozzle 26. The sheath 48 and its connected components (hose 24 and the nozzle 26) are configured to be adjusted for height by loosening a height adjustment knob 91 which allows for the free up and down movement of the sheath 48. In one embodiment, the nozzle 26 rests on a platform 54 which also serves to collect and direct any water drips into the bowl 14 The seat cover 20 is enabled to pivot from an open to a closed position as known in the art.

Figure 3A:
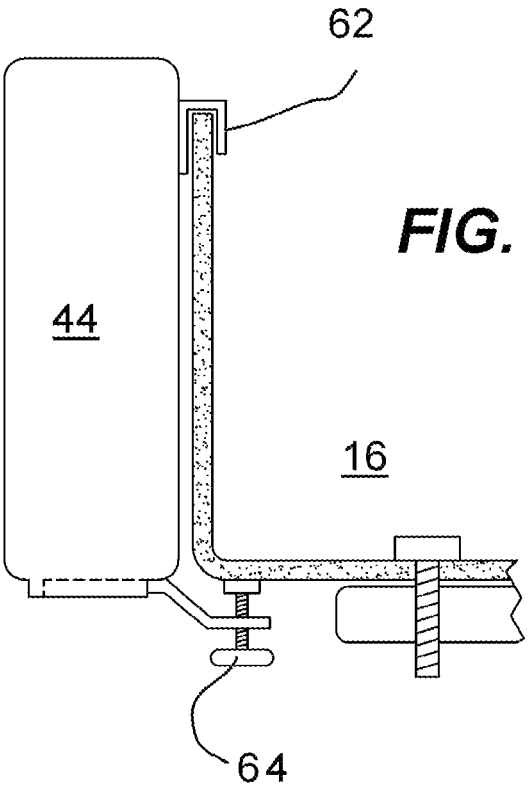
FIGS. 3A-B illustrate a side cutaway and top view of the add-on bidet module for a toilet according to embodiments of the present invention.
Figure 3B:
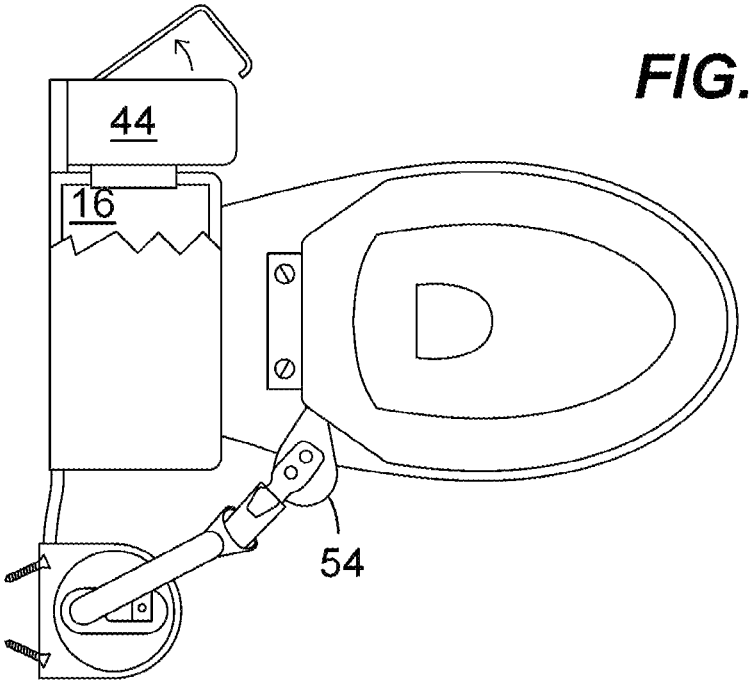

Best seen in FIGS. 3A-B, a lateral container 44 attached to the side of the tank 16 is provided, wherein the lateral container serves as storage. In one embodiment, the lateral container is attached by way of an upper hook 62 at the top and a clamping screw 64 at the bottom of the tank 16.

Figure 4A:
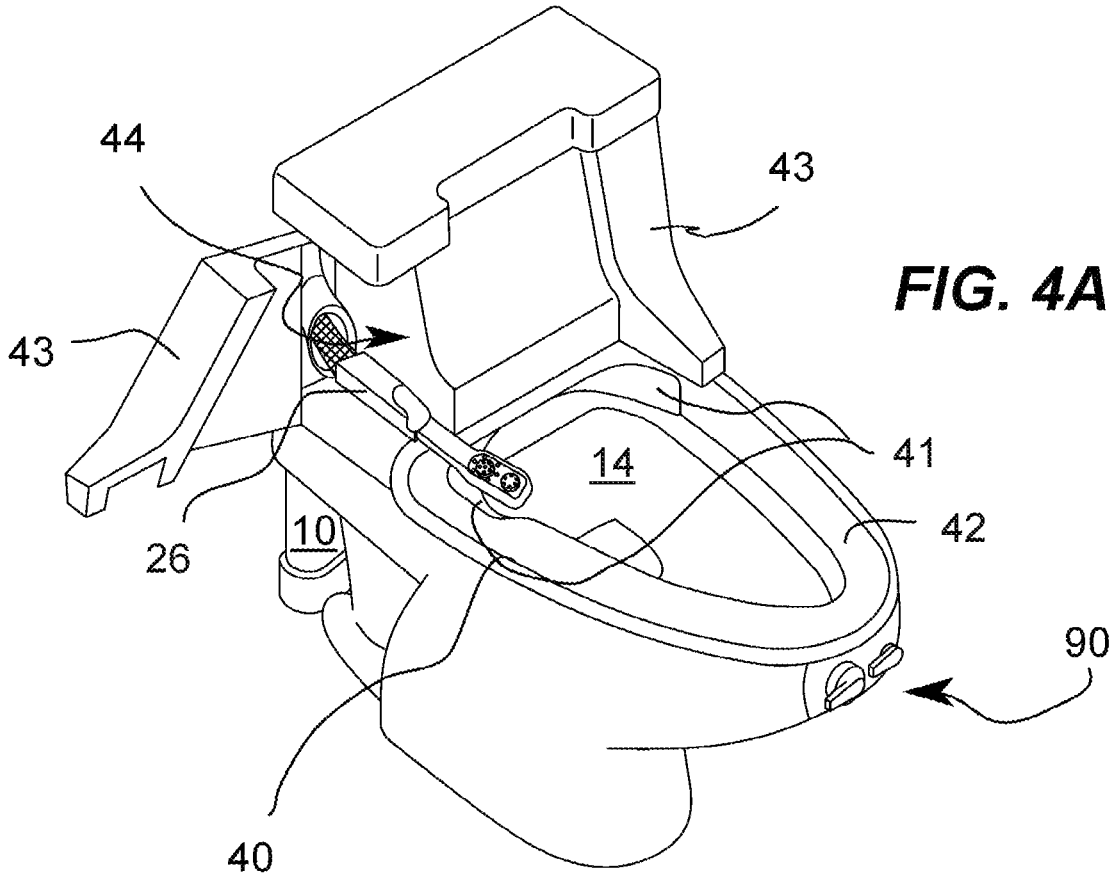
FIG. 4A is an isometric view of an alternate embodiment having a door to cover the shower assembly and an entry points for the nozzle shaped into the rim of the bowl.
Figure 4B:
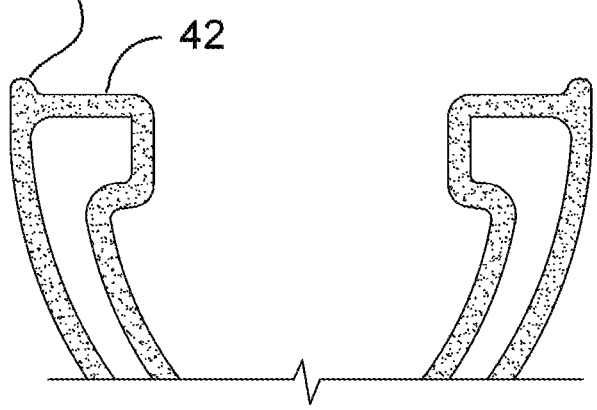
FIG. 4B is a cutaway front view showing the ridge around the bowl.

In some embodiments, as best seen in FIGS. 4A-B, the nozzle 26 is pulled out of a compartment 44 by opening a flap door 43. Depending if the user is left handed or right handed determines which of the left or right flap opening 38 is used. In some embodiments, the compartment 44 includes a sloped shape to better sequester the nozzle 26 whether the seat 18 is raised or lowered. With the nozzle 26 positioned there, in combination with a recessed form 41 forming part of a rim portion 42 allows for the dripping of the nozzle 26 and directs the drippings directly into the bowl 14.

In some embodiments, a ridge 40 is provided on the top surface of the rim portion 42, wherein the ridge is configured to prevent any water splashing from the nozzle to drip down the sides of the bowl 14. The ridge is also configured to protect the faucets 90 located at the front of the bowl from any fluid overflow, such as urine, for example. There is a pair of compartments 44 on each side of the tank 16. Each compartment 44 is closed by way of a flap door 43. In one embodiment, at least one flap door 43 is provided forming part of a container on the side of the tank 16.

Figures 5A, 5B:
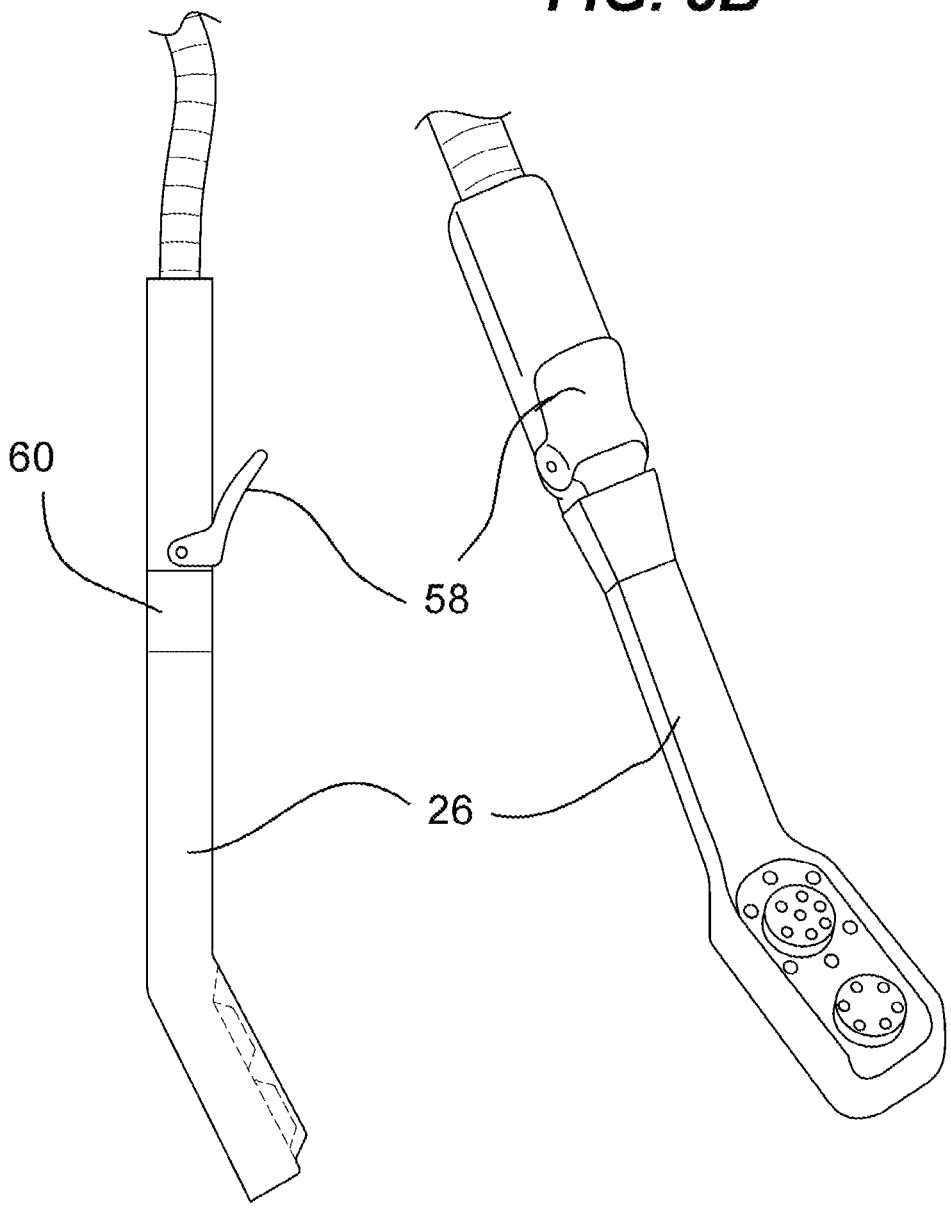
FIGS. 5A-B illustrate a side and isometric view of the nozzle.
Figure 6:
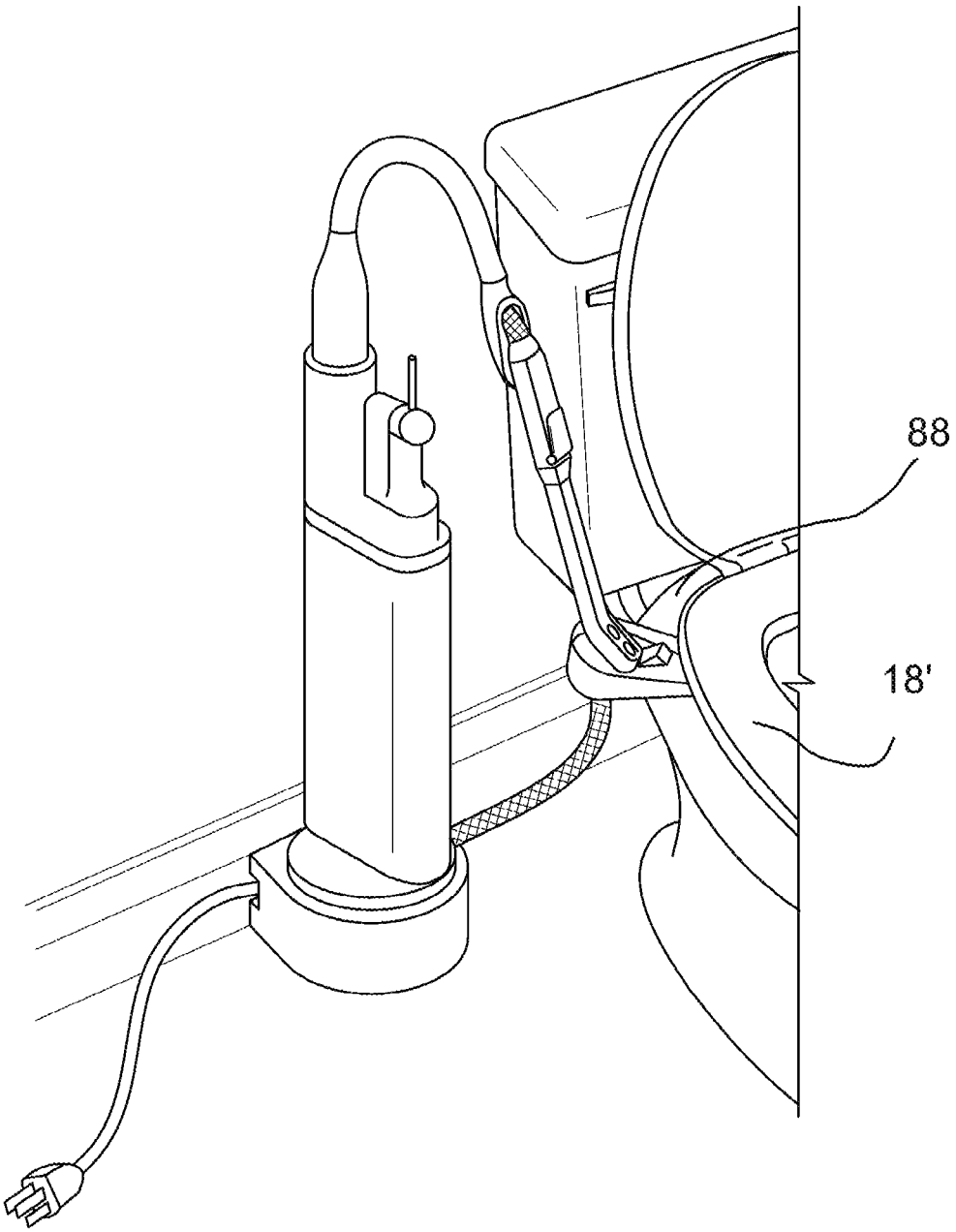
FIG. 6 is an isometric view of a standard toilet with a standard seat using the add-on module.

Referring now to FIGS. 5A-B, the nozzle 26 is shown, wherein the nozzle includes a trigger 58 on the nozzle 26 for controlling the flow of water as well as a water jet selector switch 60. The jet selector switch is similar to that of a garden hose or a shower head in the sense that the water flow can come out in different fashions.

Advantageously, the nozzle 26 is enabled to slide freely through the flap opening 38. Generally, the weight of the hose 24 on the side of the tank 16 helps in retracting it back when not in use. Also, the hose 24 is long enough so that even if it is located on a given side of the tank 16 it can still reach the flap opening 38 located on the opposite side so that it does not matter whether a user is left or right handed, the hose 24 is able to reach both flap openings 38 or go to the front of the bowl 14 for using on the genitalia.

Figure 7:
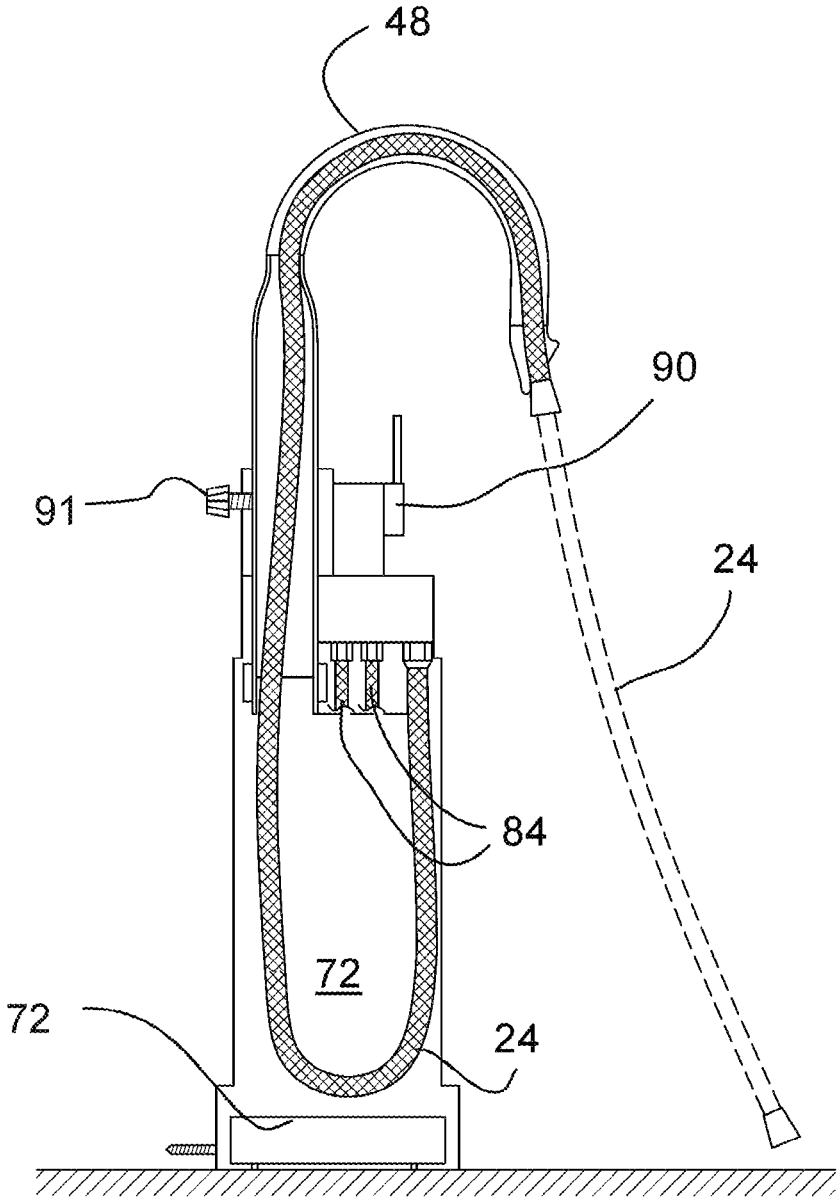
FIG. 7 is a cutaway side view of the embodiment of the add-on module.
Figure 10A:
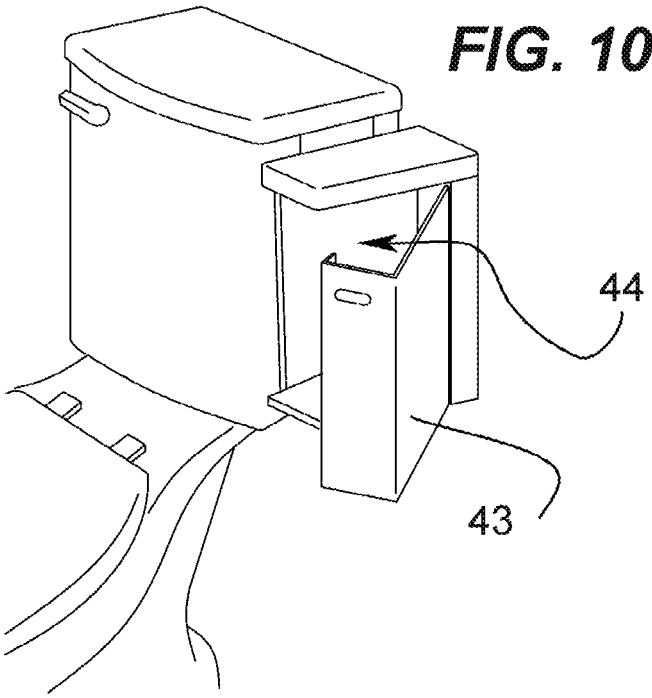
FIG. 10 is an alternate isometric views of the compartment used on standard toilets shown installed and alone respectively.
Figure 10B:
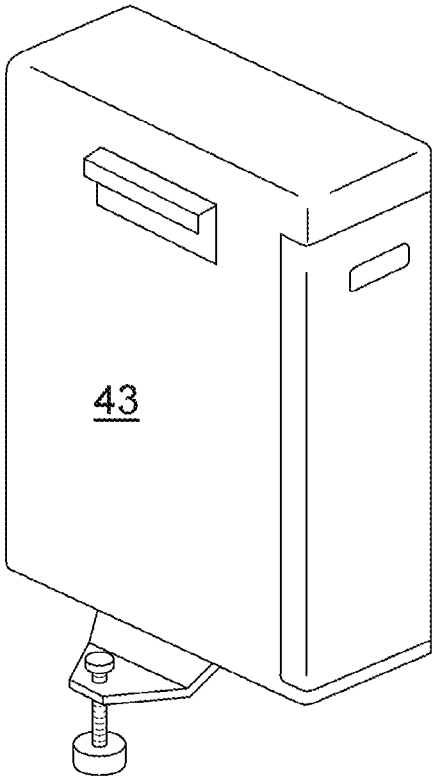
Figure 13:
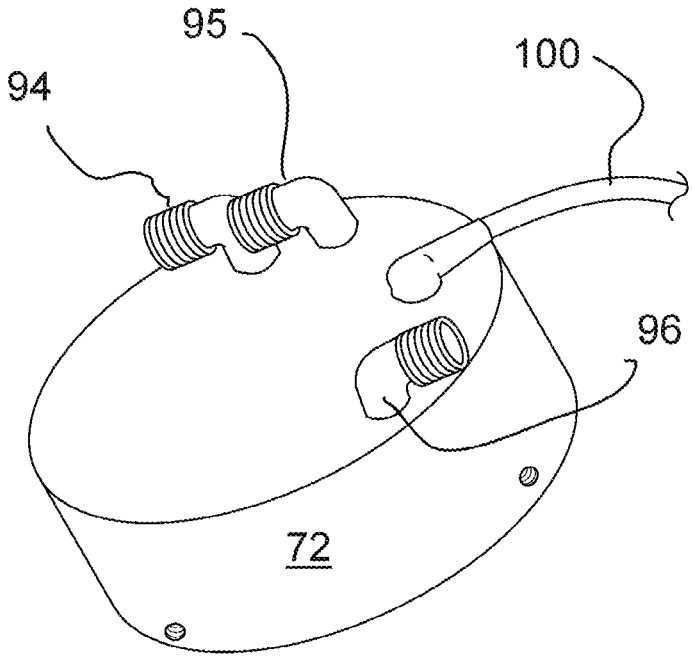
FIG. 13 is an isometric view of the water heater.

More particularly, FIGS. 7 and 13 show hot and cold water lines 84 passing through a water temperature controller 90 and then through the hose 24 leading up to the nozzle 26. In one embodiment, water is heated by way of a water heater 72 located at the base of the module 10 and screwed to the wall by way of mechanical fastener 92. In one embodiment, the water heater 72 is further comprised of a cold water inlet 96, a cold water outlet 95, and hot water outlet 94. The water is heated by way of an electric element with electronic components (not shown) with power coming from a wire 100.

FIGS. 8A-B show the platform 54, wherein the platform includes a contour 74, a flat portion 76, and a groove 78 for releasable attachment to a notch 86 located in the flap opening 38 forming part of the seat 18. In one embodiment, the flat portion 76 has a bulge 75 upon which the nozzle 26 rests, and ends with a drip spout 77 The groove is on both sides and allows the platform 54 to be flipped so as to have the groove 78 connect to the notch 86 independently of the side of the toilet 11 it is attached to.

In some embodiments, as best seen in FIG. 9A, the platform 54 is configured to be removably attached to a bolted section 80 of the toilet seat 18, which is a part that is fixedly attached to the bowl 14. In one embodiment, the bolted section includes a guide track 86 configured to interface with a groove 78 enabling platform 54 to be removable and installed as needed.

In alternative embodiments, as seen in FIG. 9B, the platform 54' may be installed on a standard toilet seat 18' by way of an extension 88 which is held in place when a standard toilet seat 18' and bolted onto the toilet bowl 14. The alternate platform 54' can easily fit under the standard toilet seat 18'. This has the advantage of being able to use on most commercially available toilet with a commercially available seat.

Figure 11:
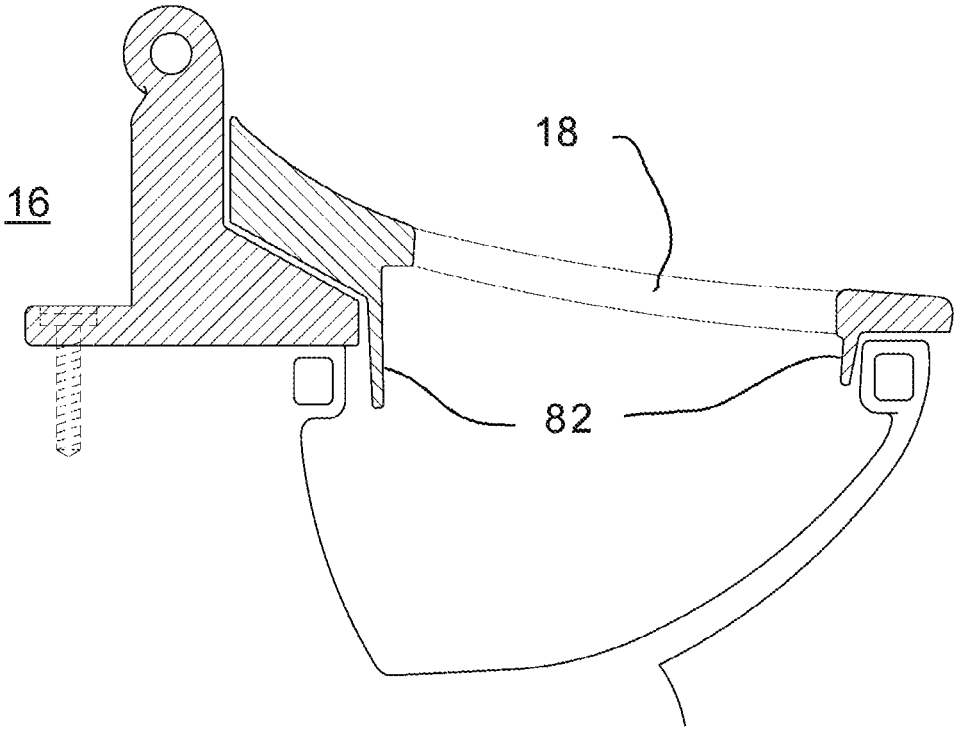
FIG. 11 is a cutaway side view of the toilet seat featuring a water barrier ridge.
Figure 12A:
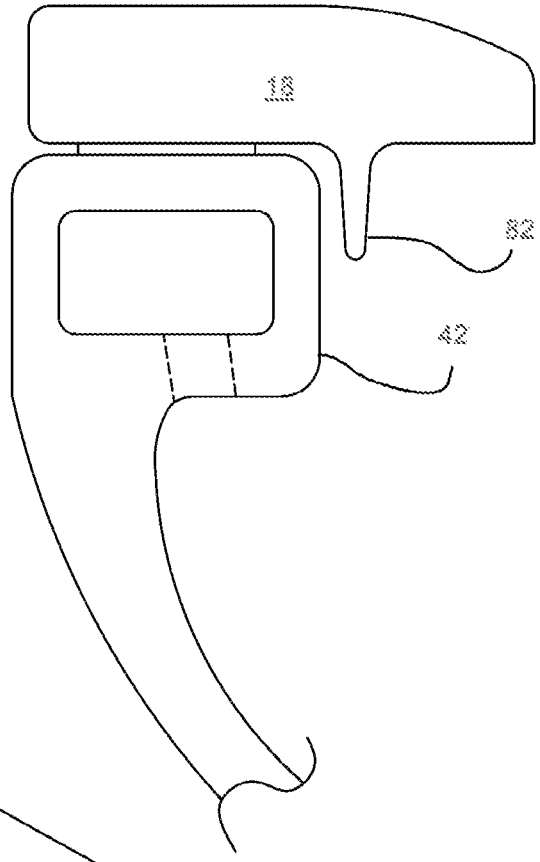
FIG. 12A is a cutaway front view of the seat with water barrier ridge.
Figure 12B:
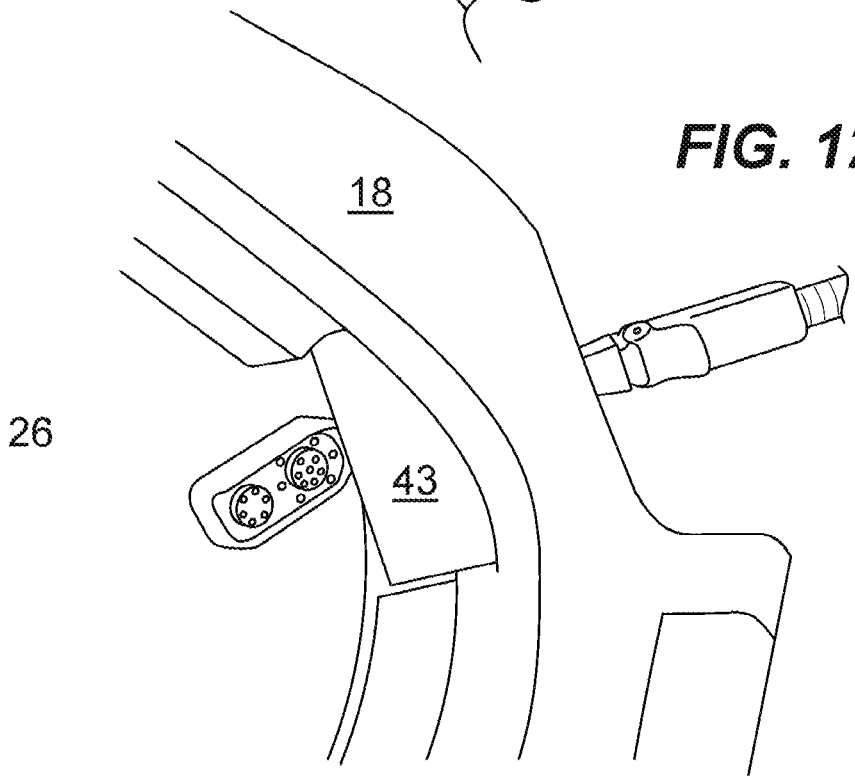
FIG. 12B is an isometric view of the seat showing the insertion point of the nozzle through the flap door.

FIG. 11 shows that the toilet seat 18 has a water barrier ridge 82 to prevent water from the nozzle 26 from being sprayed outside of the toilet bowl 14.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. An add-on bidet module for a toilet comprising:

a standing pedestal configured to be positioned on a floor surface;

a water inlet hose configured to be coupled to a water source to direct water to the add-on bidet module;

an outlet hose coupled to an extendable nozzle configured to spray the water during use; and, a faucet for controlling a flow of the water;

a platform comprising grooves configured to engage a drive track positioned on a toilet seat such that the platform is removably attached to the toilet seat:

the toilet seat having a flap opening configured to enable the nozzle to pass through to a bowl of the toilet.

2. The add-on bidet module of claim 1, further comprising a water heater configured to heat the water directed from the water source.

3. The add-on bidet module of claim 1, wherein the nozzle includes a trigger for controlling the flow of the water.

4. The add-on bidet module of claim 1, wherein the nozzle includes a jet selector switch to adjust the spray of the water during use.

5. The add-on bidet module of claim 1, wherein the outlet hose is covered by a sheath.

6. The add-on bidet module of claim 5, further comprising a height adjustment knob configured to adjust a height of the sheath and the nozzle.

7. The add-on bidet module of claim 1, further comprising a platform, wherein the nozzle is configured to rest on the platform.

8. The add-on bidet module of claim 7, wherein the platform is shaped to collect and direct water to the bowl.

9. The add-on bidet module of claim 1, further comprising a protective partition configured to adjustably slide along a pair of tracks provided on the toilet seat such that protective partition prevents the water from spraying outside the toilet bowl.

10. The add-on bidet module of claim 9, wherein the protective partition is configured to be stored in a holder positioned on a toilet seat cover hingedly attached to the toilet seat.

11. The add-on bidet module of claim 9, further comprising a storage compartment configured to attach to a toilet tank of the toilet.

* * * * *